United States Patent [19]

Van et al.

[11] Patent Number: 4,471,188

[45] Date of Patent: Sep. 11, 1984

[54] PNEUMATIC PUFFER CIRCUIT BREAKER

[75] Inventors: Doan P. Van, Meyzieu; Michel Perret; Bernard Joyeux-Bouillon, both of Villeurbanne, all of France

[73] Assignee: Alsthom-Atlantique, Paris, France

[21] Appl. No.: 463,765

[22] Filed: Feb. 4, 1983

[30] Foreign Application Priority Data

Feb. 4, 1982 [FR] France ..... 82 01818

[51] Int. Cl.[3] ..... H01H 33/88

[52] U.S. Cl. ..... 200/148 A; 200/148 R

[58] Field of Search ..... 200/148 A, 148 R

[56] References Cited

FOREIGN PATENT DOCUMENTS 2801401 2/1979 Fed. Rep. of Germany ... 200/148 A 2080626 2/1982 United Kingdom ..... 200/148 R

*Primary Examiner*—Robert S. Macon

*Attorney, Agent, or Firm*—Sughrue, Mion, Zinn, Macpeak and Seas

[57] ABSTRACT

A pneumatic puffer circuit breaker for high tension stations comprises a sealed chamber filled with a highly dielectric gas, a fixed main contact (18, 39) and at least one fixed arcing contact (9, 14, 16) disposed as co-axial cylinders and deliminiting a first volume (12). A fixed blast nozzle (24) delimits in conjunction with the fixed arcing contact an outlet passage (12A) for gas from said first volume (12). A tubular moving main contact (29) and a tubular moving arcing contact (15) are disposed coaxially with each other and with the fixed contacts, and a cylinder (10) is mounted to co-operate with the fixed main contact during circuit interruption to compress the gas in said first volume. Said cylinder has a spring (11) urging it towards a drive member (20, 31) mounted to move with said moving contacts. The cylinder includes latching means (19) for preventing the cylinder from moving, during a circuit interruption operation, in a direction other than that which tends to compress the gas in said first volume. The purpose of said latching means is to prevent back pressure from an energetic arc pushing back the cylinder, thereby creating suction instead blast from said first volume.

6 Claims, 5 Drawing Figures

PNEUMATIC PUFFER CIRCUIT BREAKER

The invention relates to an $SF_6$ pneumatic puffer circuit breaker requiring little drive energy.

BACKGROUND OF THE INVENTION

Puffer circuit breakers using $SF_6$ are well known. They include a moving assembly comprising main contact fingers, arcing contact fingers, an insulating gas blast nozzle, and a piston and cylinder arrangement. To break a circuit, the moving assembly is caused to move, thereby compressing the gas contained in the cylinder and causing it to escape through the nozzle to blast the arc which strikes between the arcing contacts thereby extinguishing it rapidly.

When a high amplitude current is to be interrupted, a large arc is created and the energy liberated may build up back pressure at the nozzle thereby slowing down the motion of the moving assembly and hindering the circuit breaking operation.

This kind of defect is remedied by increasing the energy available for driving the moving assembly, for example by using hydraulic transmission which readily enables the speed of the moving assembly to be regulated in spite of the excess drive energy available.

However, such a device is bulky and expensive; further, since little energy is needed to close the circuit through the circuit breaker compared with the energy needed to open the circuit, the circuit breaker has to respond to unbalanced drive forces which makes it difficult to construct and to adjust.

One aim of the invention is to provide a circuit breaker in which the opening speed of the moving assembly is controlled by simple means which do not need disproportionate amounts of energy for opening and for closing, but rather which tend towards similar amounts for both operations.

Another aim of the invention is to provide a circuit breaker in which the arc blasting operation is accompanied for medium to high value currents to be interrupted, by effective puffer operation.

SUMMARY OF THE INVENTION

The present invention provides a pneumatic puffer circuit breaker comprising a sealed chamber filled with a highly dielectric gas, a fixed main contact and at least one fixed arcing contact disposed as co-axial cylinders and delimiting a first volume, a fixed blast nozzle delimiting in conjunction with the fixed arcing contact an outlet passage for gas from said first volume, a tubular moving main contact and a tubular moving arcing contact disposed coaxially with each other and with the fixed contacts, and a cylinder mounted to co-operate with the fixed main contact during circuit interruption to compress the gas in said first volume, said cylinder having a spring urging it towards a drive member mounted to move with said moving contacts, the improvement wherein the cylinder includes latching means for preventing the cylinder from moving, during a circuit interruption operation, in a direction other than that which tends to compress the gas in said first volume.

In a preferred embodiment, said latching means comprise wedges lodged in recesses in the end of the cylinder, said recesses being open both towards the side of the fixed main contact and towards the end of the cylinder, said wedges being urged by respective springs to move out from their recesses, the recesses and the wedges being so shaped that the wedges tend to jam the cylinder to the fixed main contact in a chuck like manner as they are urged out from their recesses.

Advantageously, said nozzle includes at least one cavity defining a second volume having a gas blast outlet directed towards the axis of the circuit breaker.

Preferably said outlet is nozzle shaped to accelerate the gasses leaving said second volume.

Likewise, said second volume may include at least one nozzle inlet shaped to accelerate the flow of gasses into said second volume.

In one embodiment, said second volume communicates with said first volume via at least one passage.

BRIEF DESCRIPTION OF THE DRAWINGS

Embodiments of the invention are described by way of example with reference to the accompanying drawings, in which.

MORE DETAILED DESCRIPTION

Figure 1:
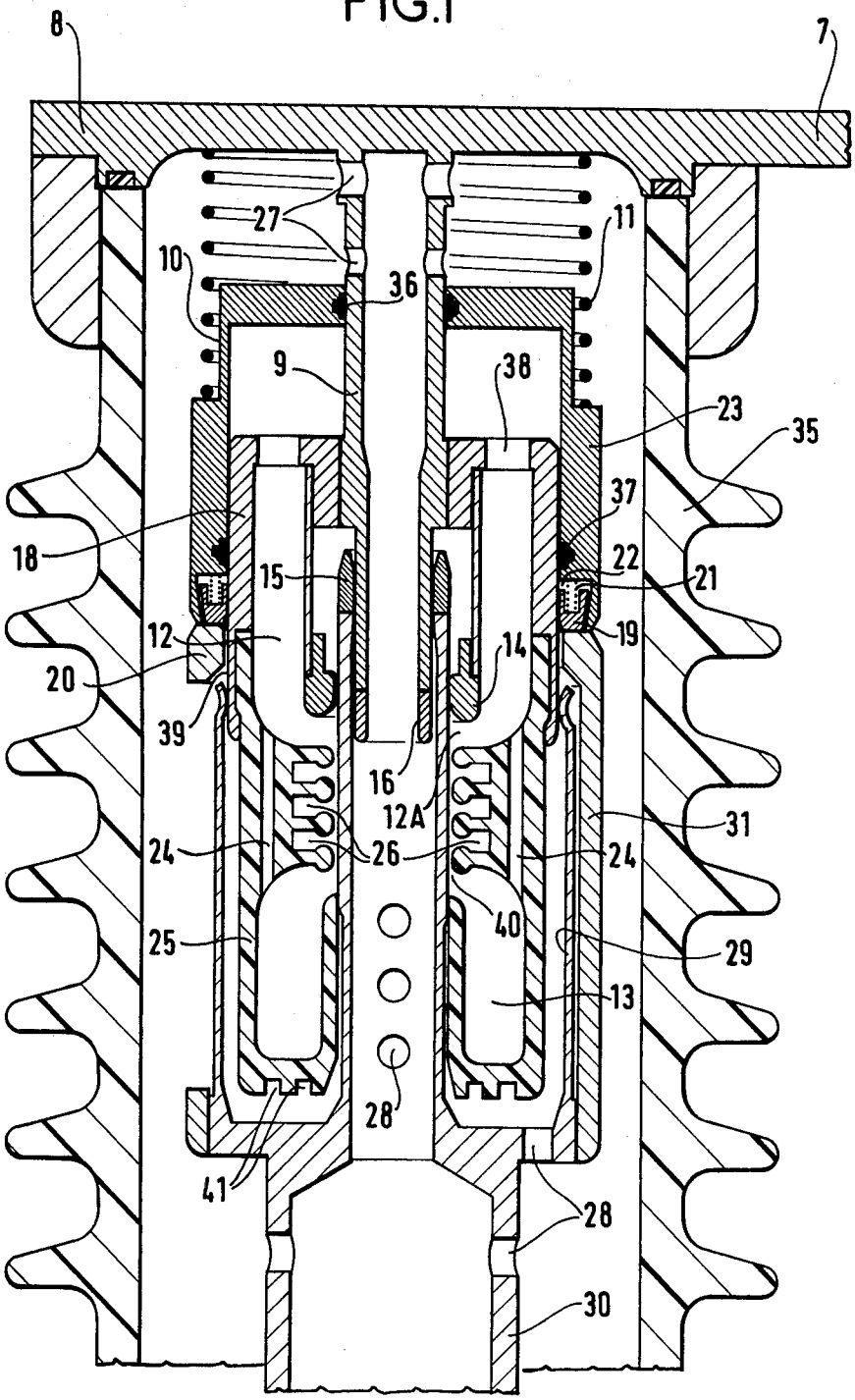
FIG. 1 is an axial section through a portion of a circuit breaker in accordance with the invention and in the closed postion.

FIG. 1 shows one end of a circuit breaker in axial section and comprising an insulating casing 35 containing sulphur hexafluoride at a pressure of several hundreds of kilo pascals. The end of the casing 35 is closed by a plate 8 of conductive material from which there depend a fixed contact holder 9 and a current connection terminal 7. The other end of the casing 35 (not shown) is closed in a similar manner, but suitable means are provided to drive the moving assembly described below.

The other end of the contact holder 9 comprises a set of arcing contacts 16. It is surrounded by a piston 18 which is pierced by orifices 38 and which ends in a contact zone 39 for the main moving contacts 29. The holder 9 is also surrounded by a second set of arcing contacts 14 in the form of a ring of fingers.

The contact holder 9 is hollow and it is provided with orifices 27 near its upper end to enable gas to flow between the main chamber and the inside of the contact holder.

A moving cylinder 10 slides over the contact holder 9 and over the piston 18 and is sealed thereto by sealing rings 36 and 37. The lower end of the cylinder terminates with a frusto-conical recess 22.

Latching means in the form of rectangular trapezium shaped wedges 19 are located in the recess 22, and their sloping sides match the slope of the conical wall of the recess 22. There are about ten wedges, and each of them includes a blind hole for receiving a spring 21 that presses against the top surface of the recess 22. The wedges may be obtained, for example, by slicing up an annulus of trapezoidal cross section.

The cylinder 10 has a spring 11 urging it away from the top plate 8.

A gas blast nozzle 25 made of insulating material is located at the end of the fixed piston 18. The nozzle delimits several volumes:

- a first volume 12 inside the piston 18 and extending down to the top of the nozzle 25;

a second volume 13 which communicates with the first via passages 24, and which communicates with the central portion via two lips 40; and a plurality of volumes such as 26 cut in the body of the nozzle and situated in between the first and second volumes 12 and 13; the volumes 26 being small relative to the volumes 12 and 13.

At the bottom of the nozzle, crenallations or corrugations 41 serve to lengthen the leakage path over the insulating material.

The moving assembly is driven by a mechanism (not shown) in the bottom part of the breaker. It comprises a tube or moving contact 30 having orifices 28 surrounded by a peripheral ring of main contact fingers 29, together with a drive member in the form of a ring 20 on top of arms 31.

The tube 30 also carries moving arcing contacts 15 near to its axis.

In the closed postion shown in FIG. 1, current passes from the moving contact 30 to the fingers 29, to the contact zone 39, to the piston 18, to the fixed contact holder 9, to the end plate 8 and thence to the treminal 7. In this position, the drive member ring 20 bears against the wedges 19, thereby enabling the cylinder 23 to slide over the piston 18.

When the contacts are opened, the moving assembly moves downwards under the thrust of the spring 11 transmitted via the the cylinder 10 keeping in touch with the drive ring 20. At the same time the cylinder compresses the gas in the volume 12 which is substantially closed. When the main contacts 29 leave the contact zone 39, all the current passes via the arcing contacts 14 and the tube 30. Then the contacts 14 and 15 come apart and the cylinder abuts against its stop. An arc is established and it is blasted by the compressed gas leaving the volume 12 via the passage 12A as the contacts 15 move away from the contacts 16. The gas escapes via the tubular portions 9 and 30 and their respective orifices 27 and 28.

If the current to be interrupted is a high current, the back pressure developed by the heat of the arc tends to lift the cylinder 10. However, at this moment, the wedges 19 are released by the drive ring 20 moving on down so their springs 17 cause the wedges to jam the cylinder to the piston 18 in the manner of the chuck of a twist drill, thereby preventing the cylinder from being lifted. The hot gasses generated in the volume 12 thus pass into the volume 13 via the passages 24 thereby bringing up the pressure therein which will facilitate interruption once the contacts 15 unblock the outlet 40 from the volume 13.

When passing in front of the volumes 26, the pressure of the gas therein is also increased thereby increasing the blast.

Figure 2:
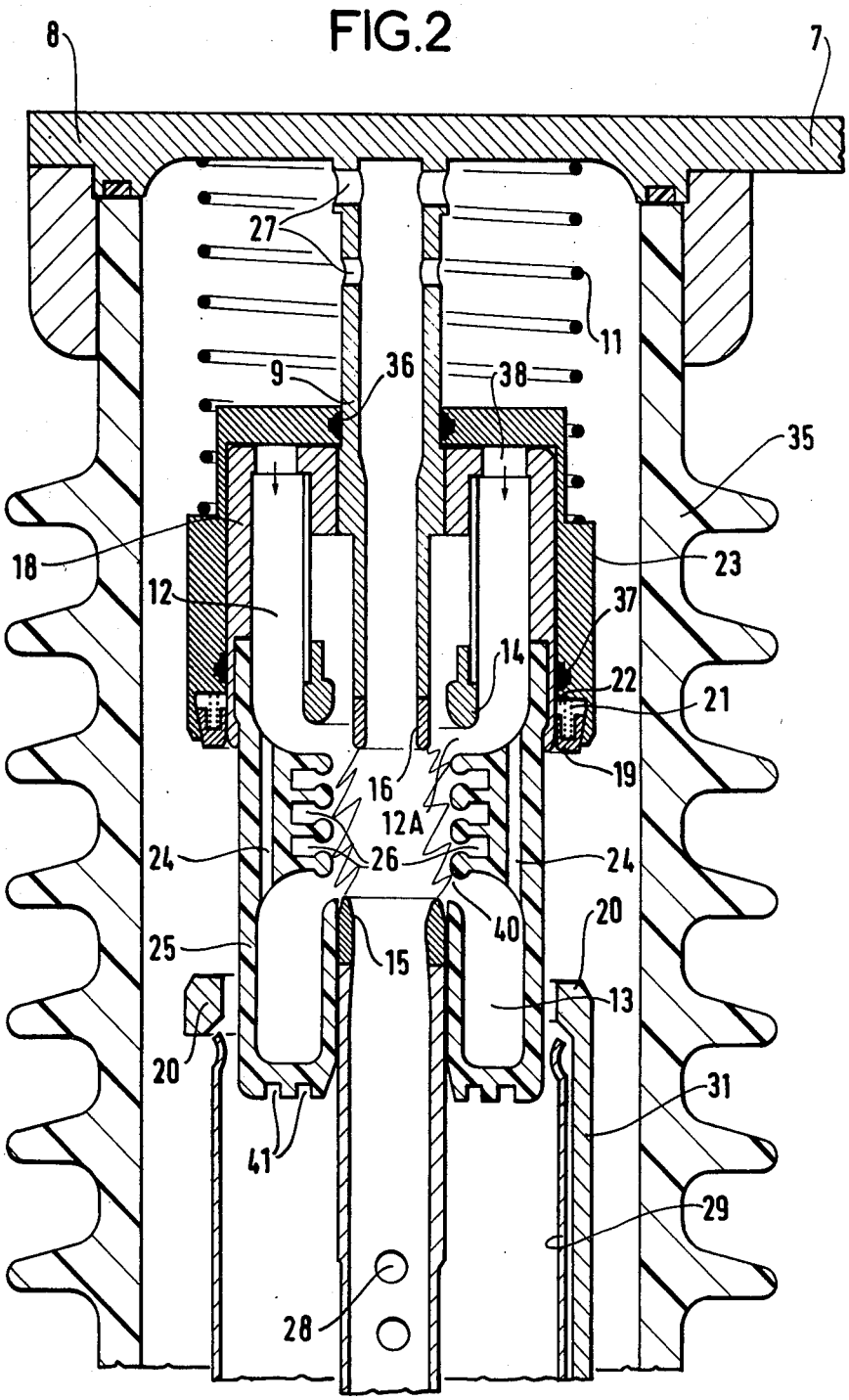
FIG. 2 is a view similar to FIG. 1 but at an intermediate stage on the way towards the open position.

If the current to be interrupted is low, the energy released by the arc is small and the gas coming from the volume 12 and then from the volume 13 is sufficient to interrupt the current (see FIG. 2).

In the case of medium value currents, the two blasts are combined and the wedging of the cylinder 10 against excessive back pressures helps to ensure interruption without incident.

When the circuit breaker is closed, the wedges 19 are lifted by the drive ring 20 thereby enabling the cylinder 10 to move upwards and compress the spring 11.

Figure 3:
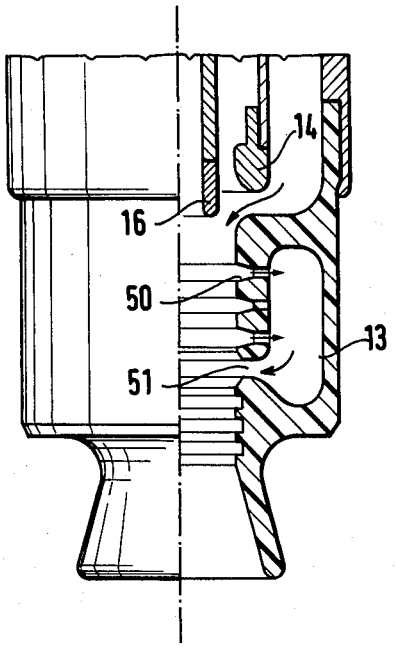
FIGS. 3, 4 and 5 are axial sections through three different embodiments of nozzles for use in the circuit breaker.

The insulating nozzle 25 may take various forms:

In FIG. 3 the volume 13 communicates with the inside of the chamber via a plurality of channels 50 which converge in such a way as to facilitate accelerating the gas when it flows inwardly. There are no passages 24 of the kind shown in FIGS. 1 and 2. A gas outlet 51 serves to put the volume 13 into communication with the inside of the chamber. When the arcing contacts are level with the converging channels 50, the energy developed by the arc serves to drive the gas which has remained cool int the interruption zone at gas outlet 51 (see the direction of the arrows). The resulting blast on the roots of the arc at the contacts 15 uses gas which is cooler and which is less ionised than in the embodiment of FIGS. 1 and 2. The other end of the arcing at the contacts 16 is blasted by gas coming from the volume 12.

Figure 4:
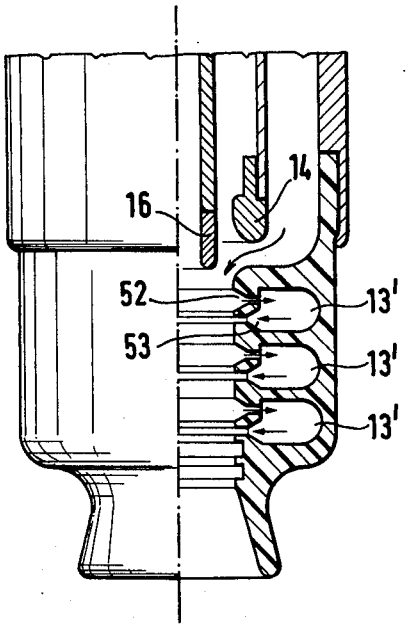

In FIG. 4, the volume 13 is divided into a plurality of elementary volumes 13', each of which has its own converging inlet 52 and diverging outlet 53. Energy from the arc enters each elementary volume 13' in the form of a shock wave travelling through the converging inlets 52, thereby causing the gasses to be mixed and then driven out through the diverging outlets 53.

Figure 5:
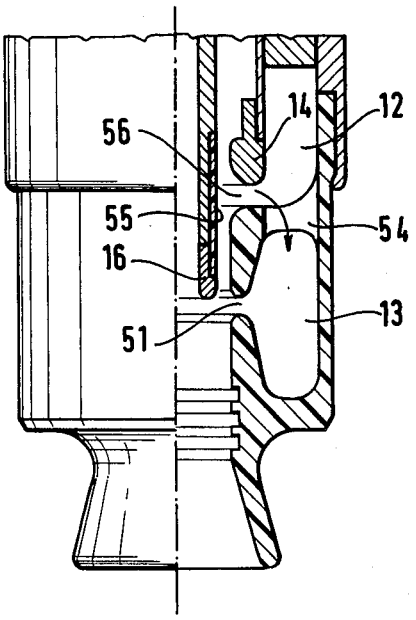

In FIG. 5, the volumes 12 and 13 communicate via large orifices 54. The arcing contact 16 is extended up to the opening 51, and is protected by an insulating tube 55 which prevents the root of the arc striking from the cylindrical region 56. The shock wave and the thermal effects due to the arc set up between the contacts 14 and 15 causes cool gas to be driven from the volume 12 into the volume 13 via the openings 54 and thence to the outlet 51. The arc between the contacts 15 and 16 is interrupted after the arc has been switched from the contacts 14 to the contacts 16.

We claim:

1. A pneumatic puffer circuit breaker comprising: a sealed chamber filled with a highly dielectric gas, a fixed main contact and at least one fixed arcing contact disposed as coaxial cylinders within said chamber and delimiting a first volume, a fixed blast nozzle within said chamber delimiting in conjunction with the fixed arcing contact an outlet passage for gas from said first volume, a tubular moving main contact and a tubular moving arcing contact disposed coaxially with each other and with the fixed contacts within said chamber, and a cylinder movably mounted within said chamber relative to the fixed main contact for movement during circuit interruption to compress the gas in said first volume, a drive member mounted within said chamber for movement with said moving contact and said cylinder having a spring urging it towards said drive member, the improvement wherein the cylinder includes means for preventing the cylinder from moving, during a circuit interruption operation, in a direction other than that which tends to compress the gas in said first volume.

2. A circuit breaker according to claim 1, wherein said preventing means comprise wedges lodged in recesses in the end of the cylinder, said recesses being open both towards the side of the fixed main contact and towards the end of the cylinder, springs respectively for urging said wedges to move out from their recesses, and the recesses and the wedges being so shaped that the wedges tend to jam the cylinder to the fixed main contact in a chuck like manner as they are urged out from their recesses.

3. A circuit breaker according to claim 1, wherein said nozzle includes at least one cavity defining a second volume having a gas blast outlet directed towards the axis of the circuit breaker.

4. A circuit breaker according to claim 3, wherein said outlet is nozzle shaped to accelerate the gasses leaving said second volume.

5. A circuit breaker according to claim 3, wherein said second volume includes at least one nozzle inlet shaped to accelerate the flow of gasses into said second volume.

6. A circuit breaker according to claim 3, wherein said second volume communicates with said first volume via at least one passage.

* * * * *